United States Patent [19]

Dekker et al.

[11] 3,962,151

[45] June 8, 1976

[54] SOLVENT TYPE CLEANERS

[75] Inventors: Abraham Dekker; Albert Willems, both of Maarssen, Netherlands

[73] Assignee: Lever Brothers Company, New York, N.Y.

[22] Filed: Aug. 6, 1973

[21] Appl. No.: 385,945

[30] Foreign Application Priority Data

Aug. 11, 1972 United Kingdom..... 37586/72

[52] U.S. Cl...... 252/548; 134/40; 252/153; 252/170; 252/DIG. 14

[51] Int. Cl.[2]..... C11D 1/44; C11D 3/43

[58] Field of Search ..... 252/544, 548, 153, 170, 252/172, 357; 134/40

[56] References Cited

UNITED STATES PATENTS

| | | | |
|---|---|---|---|
| 2,165,356 | 7/1939 | Dunbar | 252/153 |
| 3,018,251 | 1/1962 | Mayhew et al. | 252/153 X |
| 3,057,676 | 10/1962 | Wedell | 252/544 X |
| 3,086,938 | 4/1963 | Means et al. | 252/8.55 |
| 3,125,517 | 3/1964 | Voda | 252/357 X |
| 3,222,286 | 12/1965 | Barnes | 252/559 |
| 3,277,013 | 10/1966 | Gianladis | 252/153 |

FOREIGN PATENTS OR APPLICATIONS

| | | | |
|---|---|---|---|
| 1,104,287 | 1/1959 | Germany | |
| 1,195,796 | 6/1970 | United Kingdom | 252/153 |

*Primary Examiner*—Herbert B. Guynn
*Attorney, Agent, or Firm*—Kenneth F. Dusyn; James J. Farrell; Arnold Grant

[57] ABSTRACT

Solvent type cleaner with quick breaking emulsion properties for cold cleaning of metal surfaces, concrete structures, brickwork etc. comprising essentially a hydrocarbon solvent and a cationic emulsifier and optionally a nonionic surfactant. The solvent type cleaners are used in cold immersion cleaning and mechanical spray cleaning.

Suitable cationic emulsifiers are higher alkyl and alkenyl amines having the general formula:

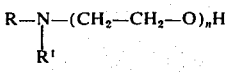

in which R is an alkyl or alkenyl group containing 8–14 25 carbon atoms; $n = 0–5$; $R^1$ is either $(CH_2—CH_2—O)_mH$ with $m = 0–5$, or an alkyl or alkenyl group having 8–25 carbon atoms.

2 Claims, No Drawings

SOLVENT TYPE CLEANERS

BACKGROUND OF THE INVENTION

1. Field of the Invention

The invention relates to solvent type cleaners with quick breaking emulsion properties, for cold cleaning of metal surfaces, concrete structures, brickwork, etc. which have been soiled with dirty mineral oil residues, oily and greasy dust, tarry substances and the like.

The term "cold cleaning" is used herein to indicate cleaning at ambient temperature up to 50°C, and includes mechanical spray-cleaning as well as immersion cleaning.

2. Description of the Prior Art

Cold-immersion cleaners and mechanical spray cleaners for defatting of objects, particularly metal surfaces, are known in the art. They normally comprise a solvent, particularly a hydrocarbon solvent, and a suitable emulsifying agent.

Solvent cleaners of this type are preferably used for cleaning heavily soiled automotive engines and moving parts, such as wheels. Cleaning is generally accomplished by spraying the objects with the cleaner composition, by which on account of its solvent and emulsifying action the fatty and sticky soil is softened and loosened from the solid surface. After a certain time the loosened oily dirt still remaining on the surface is flushed with a copious and powerful spray of water.

By this operation an oil-in-water emulsion is formed which should pass an oil separator before the waste water can be drained as effluent water into open waters.

In composing a cleaning agent of this type it is important not only to achieve effective cleaning, but also to have a composition which produces with the flush water an emulsion which is capable of breaking into a water phase and an oil phase in a sufficiently short time, otherwise very large and expensive oil separators are needed to fulfil the requirements as to capacity.

Waste water pollution nowadays has become a serious problem all over the world, and authorities of many countries prohibit disposal of mineral oil products into municipal sewage systems. In some countries legal regulations exist which "emulsion cleaners" must comply with.

Many known solvent type cleaners do not produce a sufficiently quick breaking emulsion, and are therefore disadvantageous in use.

In German patent application No. 1935510 a solvent type cleaner is disclosed comprising a hydrocarbon solvent and a nonionic emulsifying agent, consisting of a mixture of dinonylphenol condensed with 4-6 ethylene oxide and monononylphenol condensed with 4-6 ethylene oxide.

The disadvantage of this emulsifier mixture is that it should be used at a rather high level (3–15%) in order to achieve the desired effects. Moreover, use of this specific nonionic mixture at the above level may generate too much foam, which is undesirable and therefore an anti-foaming agent is generally required.

SUMMARY OF THE INVENTION

It is an object of the present invention to provide an improved solvent type cleaner for the cleaning of metal objects, concrete structures, brickwork etc, which will not show the above disadvantages.

One particular object of the present invention is the provision of an effective, substantially non-foaming solvent spray-cleaner composition with quick breaking emulsion properties.

Another particular object of the invention is the provision of an effective solvent type cleaner for use in immersion cleaning of metal objects.

According to the invention the above objects are accomplished by using a cationic emulsifier.

DESCRIPTION

It has been found that by using a cationic emulsifier in solvent cleaners a much lower level of emulsifier is needed to achieve quick breaking emulsion properties.

Generally a level of cationic emulsifier as low as about 0.2% up to a maximum of about 2.0% by weight of the total composition is adequate to achieve the desired results. Though a higher level up to say 5% may be used, it was observed that such increased level of use is not normally necessary, since the improvement obtained will be normally only marginal.

Suitable cationic emulsifiers for use in the present invention are higher alkyl and alkenyl amines having the following general formula:

$$R-\underset{\underset{R^1}{|}}{N}-(CH_2-CH_2-O)_nH$$

in which R is an alkyl or alkenyl group containing 8–25 carbon atoms; n is a number of 0–5; and $R^1$ is either $(CH_2-CH_2-O)_mH$ with m being from 0–5, or an alkyl or alkenyl group containing 8–25 carbon atoms.

Typical examples of cationic emulsifiers of this group are: $C_{12}H_{25}NH.CH_2CH_2OH$; $C_{20}H_{41}N(CH_2CH_2OH)_2$; $C_{22}H_{45}NH(CH_2CH_2O)_2H$; $C_{18}H_{37}NH.CH_2CH_2OH$; $C_{24}H_{49}NH(CH_2CH_2O)_3H$ and $C_{18}H_{37}N(CH_2CH_2OH)_2$.

Preferred ethoxylated amines are commercial mixtures obtained from the condensation of primary fatty amines containing predominantly 12–20 carbon atoms derived from animal and vegetable fats, such as coconut oil, tallow, soybean oil, cottonseed oil, stearine, oleine etc., with 1–5 ethylene oxide molecules.

Other suitable cationic emulsifiers falling within the definition are secondary higher alkyl and alkenyl amines, $R_1R_2NH$, in which $R_1$ and $R_2$ are alkyl or alkenyl groups containing from 8–25 carbon atoms.

Typical secondary alkyl and alkenyl amines are: $(C_{12}H_{25})_2NH$; $(C_{14}H_{29})(C_{16}H_{33})NH$ and $(C_{18}H_{37})_2NH$.

Accordingly the solvent type cleaner of the present invention comprises essentially a hydrocarbon solvent and a cationic amulsifier as hereinbefore defined.

Preferably a kerosene petroleum distillate is used as the hydrocarbon solvent. Particularly if the cleaner is used for spray-cleaning it is desirable to use a kerosene fraction having a sufficiently high flash point, preferably above 55°C.

Minor amounts of a nonionic surface-active compound may be incorporated in the clean composition of the invention, as desired, to aid in the cleaning action of the composition, without being detrimental to its quick breaking emulsion properties.

As a suitable nonionic surface-active compound any of the conventional water-soluble nonionic detergents can be mentioned. Such nonionics generally have a hydrophobic group containing at least 8 carbon atoms, preferably 8–30 carbon atoms, and a hydrophylic group consisting of alkylene oxide units generally a polyoxyethylene group consisting of 1–25 ethylene oxide units. One particular class of such nonionic surface-active compounds is that formed by the condensation of fatty acids, primary or secondary alcohols, alkylphenols, mercaptans, thiophenols, amines and amides, with ethylene oxide and/or propylene oxide. Such suitable materials usually have at least one mole of alkylene oxide up to 25 moles of alkylene oxide, depending upon the particular hydrophobic and hydrophylic group desired.

Another type of nonionic detergent material is that which is formed by the condensation of ethylene oxide with polyoxypropylene, known commercially as "Pluronics". "Pluronic" is a registered trade mark. These and other types of nonionic surfactants are described in "Nonionic surfactants" by Martin Schick, Surfactant Science Series Vol. 1 (1967) published by Marcel Dekker Inc. New York.

Generally an amount of not more than 1.25%, and preferably between 0.5–1.0% by weight of nonionic surface-active compound is adequate to provide an improved cleansing action.

In one preferred embodiment of the invention a solvent type cleaner with good cleaning action and quick breaking emulsion properties is provided which contains in addition to a cationic emulsifier as hereinbefore defined, a mixture of low ethoxylated and high ethoxylated nonionics.

By low ethoxylated nonionics as contemplated herein is meant those nonionics having up to 5 ethylene oxide units. By high ethoxylated nonionics as contemplated herein are meant those nonionics having from 8–25 ethylene oxide units.

It has been discovered that excellent cleaning action combined with quick breaking emulsion properties are obtained if the low ethoxylated nonionic and the high ethoxylated nonionic are present in the composition in a weight ratio of between 2:1 and 15:1, preferably between 5:1 and 10:1.

The cleaner composition according to the invention may further contain minor amounts of adjuncts to give the product an attractive appearance, provided that the essential properties are not adversely affected thereby. Such adjuncts are e.g. solubilizing or clearing agents known in the art, such as cyclohexanol which give the product a translucid appearance.

As has been said before, the invention is suitable for use in the cleaning of metal objects, concrete structures, brickwork etc. Other specific uses are those directed to the spray-cleaning of vehicles and vehicle parts, such as wheel rims, and to spray-cleaning/dewaxing of new cars.

The following Examples will illustrate the invention, the percentages being percentages by weight.

EXAMPLES I – II

The following compositions were made by blending the ingredients in the solvent medium.

| Composition | I % by weight | II % by weight |
|---|---|---|
| $C_{11}$-$C_{15}$ alcohol condensed with 12 ethylene oxide units | 0.05 | 0.1 |
| Nonylphenol-3-ethylene oxide | 0.45 | 0.7 |
| Monoethoxylated stearyl amine | 1.5 | 0.7 |

-continued

| Composition | I % by weight | II % by weight |
|---|---|---|
| Kerosene (Flash point 72°C) | 98.0 | 98.5 |

These products were tested for cleaning heavily soiled automotive engines, using a spray-gun.

Three minutes after the spraying was stopped — to give the solvent cleaner time to react — the engines were flushed with a copious and powerful spray of water. The emulsion formed and collected in a conventional oil separator separated within 3 minutes.

The engines were after this treatment exmined and appeared to be perfectly cleaned.

EXAMPLE III

| Composition | % by weight |
|---|---|
| $C_{11}$-$C_{15}$ alcohol condensed with 12 ethylene oxide units | 0.1 |
| Nonylphenol-3-ethylene oxide | 0.7 |
| Monoethoxylated coconut fatty amine | 0.7 |
| Cyclohexanol | 3.0 |
| Kerosene (Flash point 70°C) | 95.5 |

This clear liquid product showed the same performance as products I and II from Examples I – II.

EXAMPLE IV

A satisfactory cleaning effect was also obtained with the following composition using the spray-test method as described in Examples I – II.

| Composition | % by weight |
|---|---|
| $C_{16}$-$C_{18}$ fatty amine-monoethoxylate | 2.0 |
| Kerosene (Flash poin 65°C) | 98.0 |

The emulsion formed from composition IV broke down in 1 min, using the following test method:

Put 18 ml of the cleaner and 2 ml dirty oil together in a measuring cylinder. Fill the cylinder with water to make up 1 liter, shake well for some time and then measure the time it takes for 95% of all oily components to separate from the water phase.

EXAMPLES V – VI

The following compositions were prepared and tested for emulsion breaking properties using the same test method as described in Example VI.

| Composition | % by weight | |
|---|---|---|
| | V | VI |
| Dilauryl amine "$(C_{12}H_{25})_2NH$" | 0.7 | — |
| Stearyl amine condensed with 5 ethylene oxide units | — | 0.5 |
| $C_{11}$-$C_{15}$ secondary alcohol condensed with 3 ethylene oxide units | 0.7 | 0.7 |
| Cyclohexanol | 3.5 | 3.5 |
| Kerosene (Flash point 70°C) | 95.1 | 95.3 |

The emulsion formed from composition V broke in 1.5 minutes.
The emulsion formed from composition VI broke in 3 minutes.

EXAMPLES VII – VIII

To illustrate the superiority of the invention over compositions known in the art the following comparative tests were made.

Two compositions VII and VIII were prepared according to the invention and two other compositions A and B with corresponding levels of nonionic emulsifiers were used for comparison.

The test method used was similar to the one as described in Example IV, but this time the rate of separation was judged from the amount of oil layer measured at different time intervals, combined with a visual judgement of the physical form of the layers.

The test-results are shown in the following Table.

TABLE

| Product | Separation (= ml oil) after: | | | | Judgement of layers after | | | |
|---|---|---|---|---|---|---|---|---|
| | | | | | 15 min | | 1440 min | |
| | 2 min | 3 min | 4 min | 15 min | upper layer | lower layer | upper layer | lower layer |
| VII | 40 | 50 | 50 | 50 | moderate | moderate | very good | very good |
| A | 10 | 20 | 20 | 30 | very bad | very bad | very bad | very bad |
| VIII | 30 | 60 | 60 | 60 | bad | bad | very good | very good |
| B | 20 | 20 | 25 | 30 | very bad | bad | bad | good |

From the above Table it is clear that solvent cleaner compositions containing the known nonionic emulsifiers were poor with respect to their quick emulsion breaking properties, as compared with the present solvent cleaner compositions of the invention.

Composition A with a low level of nonionic emulsifiers showed a very poor performance, i.e. quite insufficient separation combined with very bad layers even after 1440 minutes (24 hours).

With composition B with the high level of nonionic emulsifiers the results were not much better either, and were clearly still very much inferior to the results obtained with compositions VII and VIII of the invention.

We claim:

1. A non-aqueous solvent type cleaner composition with quick breaking emulsion properties for cleaning metal surfaces, concrete structures, brickwork and the like, consisting essentially of 94.0–98.5% by weight of a non-chlorinated hydrocarbon solvent comprising a kerosene distillate with a flash point of at least 55°C, and about 0.2–5.0% by weight of a cationic emulsifier having the formula:

$$R-\underset{\underset{R_1}{|}}{N}-(CH_2-CH_2-O)_nH$$

| Compositions | % by weight | | | |
|---|---|---|---|---|
| | VII | A | VIII | B |
| Dinonylphenol-4-ethylene oxide | — | 0.4 | — | 1.0 |
| Dinonylphenol-7-ethylene oxide | — | 0.4 | — | 1.0 |
| Nonylphenol-4.5-ethylene oxide | — | 1.2 | — | 3.0 |
| Shellsol K (Shell Kerosene, Flash point 66°C) | 98.0 | 98.0 | 94.0 | 94.0 |
| $C_{16}$-$C_{18}$ fatty amin-monoethoxylate | 2.0 | — | 5.0 | — |
| Pine oil | — | — | 1.0 | 1.0 |

in which R is an alkyl or alkenyl group containing 8–25 carbon atoms; n is a number from 1–5; and $R^1$ is either $(CH_2-CH_2-O)_mH$, m being from 0–5, or an alkyl or alkenyl group containing 8–25 carbon atoms, and 0.5–1.0% by weight of an ethylene oxide condensate nonionic surface-active compound comprising a mixture of a low ethoxylated compound having up to 5 ethylene oxide units and a high ethoxylated compound having from 8–25 ethylene oxide units, in a weight ratio of from 2:1 to 15:1.

2. A cleaner composition as claimed in claim 1, wherein said cationic emulsifier is present in an amount of about 0.2 to about 2.0% by weight of the total composition.

* * * * *